US005542153A

United States Patent [19]

Ramsby et al.

[11] Patent Number: 5,542,153

[45] Date of Patent: Aug. 6, 1996

[54] SIMULATED BUTT HINGE CONSTRUCTION

[76] Inventors: Scott D. Ramsby, Frenchtown Post Office, 16 Trenton Ave., Frenchtown, N.J. 08825-9998; Alan B. Miller, Stockton Post Office, 2 Bridge St., Stockton, N.J. 08559-9998

[21] Appl. No.: 504,641

[22] Filed: Jul. 20, 1995

Related U.S. Application Data

[63] Continuation-in-part of Ser. No. 345,732, Dec. 20, 1994, abandoned.

[51] Int. Cl.[6] ..... E05D 5/06

[52] U.S. Cl. ..... 16/389; 16/221; 16/250; 16/DIG 43

[58] Field of Search ..... 16/221, 250, 251, 16/387, 388, 389, 390, 391, 392, DIG 43

[56] References Cited

U.S. PATENT DOCUMENTS

| | | | |
|---|---|---|---|
| 2,624,067 | 1/1953 | Tassell | 16/389 |
| 3,445,883 | 5/1969 | Lowe . | |
| 3,851,354 | 12/1974 | Anderson . | |
| 3,991,436 | 11/1976 | Nagase . | |
| 3,999,246 | 12/1976 | Suska | 16/308 |
| 4,353,146 | 10/1982 | Brockhaus . | |
| 4,825,508 | 5/1989 | Post, Jr. | 16/250 |
| 4,962,567 | 10/1990 | Dixon . | |
| 4,991,259 | 2/1991 | Finkelstien et al. . | |
| 5,335,460 | 8/1994 | Smith, Jr. | 16/389 |

OTHER PUBLICATIONS

Hafele—Antique Style Hinges.

*Primary Examiner*—W. Donald Bray
*Attorney, Agent, or Firm*—William Squire

[57] ABSTRACT

A simulated butt hinge assembly comprises an artificial knuckle-pintle-finial butt hinge attached to an L-shaped plate structure. The artificial butt hinge comprises spaced knuckle simulating grooves in a one-piece cylindrical member with finials formed at opposite ends of the cylindrical member, the grooves simulating separate knuckles. The L-shaped plate structure has one plate extending from the artificial hinge assembly and a second plate which is clamped between a flange of a snap type hidden articulating hinge and a movable panel. The articulating hinge has a second flange secured to a frame to rotatably secure the panel to the frame. The artificial hinge protrudes from the part of the panel to simulate a butt hinge. Other embodiments are disclosed including a multiple separate knuckles in an artificial hinge.

19 Claims, 5 Drawing Sheets

SIMULATED BUTT HINGE CONSTRUCTION

This is a continuation in part application of application Ser. No. 345,732 filed Dec. 20, 1994, and now abandoned.

This invention relates to butt hinges and, more particularly, to decorative hinges.

Butt hinges are in wide use and comprise two plates each of which have a gudgeon comprising a set of knuckles which are cylindrical tubular journals. The knuckles are arranged to align in interleaved fashion. A pintle or hinge pin is passed through the aligned knuckles to form the hinge. One plate is typically attached to a face frame of a cabinet and the other to a door to be hinged to the frame. The plates are butt attached to the mating surfaces, usually inserted in a mortise, and typically face one another when the door is closed. When the door is closed only the hinge comprising the aligned knuckles of the gudgeon with the pintle is visible. The plates are observable in full when the door is opened. The plates may extend partially from the door and casement so they and the hinge are visible when the door is closed.

Examples of prior art butt hinges are disclosed in U.S. Pat. Nos. 3,851,354; 3,991,436; 4,353,146; 4,962,567 and 4,991,259.

Another type of hinge is referred to as a European hinge. This is a hinge which is spring loaded to have two snap positions, open or closed. This hinge is used to hinge a door to a casement and is located interior the cabinet. Often such hinges are employed in cabinet type structures. In modern type cabinets, the butt hinge is considered inappropriate because the butt hinge is considered more traditional. The presence of such butt hinges generally on the outside of such cabinets is therefore undesirable. Modern cabinets tend to use the European hinges which are typically hidden within the cabinet interior. All of the European hinge elements are secured to the cabinet walls and doors in the cabinet interior so they are only visible when the door is opened. The exterior of the cabinet is flush and clean looking.

The European hinge, however, has become associated with modern furniture and cabinets. The butt hinge has become associated with more traditional type of furniture or cabinets. Once the European hinge has been installed it can not easily be replaced with butt hinges if a different traditional look is desired for the cabinets. This is because the European hinge as illustrated in FIGS. 5, 6 and 7 herein and discussed in the specification require drilled recesses especially adapted for these type of hinges. Therefore, those who would like to replace the European hinge with a traditional butt hinge can not do so because the drilled recess are unsightly if exposed.

The present inventors recognize a need for a hinge arrangement which will solve this problem by providing a butt hinge look to cabinets with installed European hinges. It is not a matter of simply attaching a butt hinge to European hinged cabinet. These hinges have different hinge axes which are not compatible. Also, the installation of a butt hinge with a preinstalled European hinge would double the number of hinges and undesirable.

According to the present invention, a simulated butt hinge construction is provided for attachment to a first support. The simulated butt hinge comprises a plate member arranged to be attached to the first support and an artificial butt hinge secured to the plate member for providing a simulated appearance of a butt hinge to the first support.

In a preferred embodiment, the artificial butt hinge and plate member are an integral one piece unit.

In accordance with a further embodiment, the plate member is L-shaped for abutting the first support in two orthogonal planes.

In a still further embodiment, an articulating hinge is attached to a first support surface on the first support for movably securing the first support to a second support wherein the L-shaped plate member has a first leg secured to the artificial butt hinge and a second leg joined to the first leg at a joint therebetween, the second leg being arranged to be secured to the first support surface, the first support having a second surface overlying and opposing the first surface, the artificial hinge being located adjacent to the second surface.

In a further embodiment, the articulating hinge has a flange for attachment to the first support, the second leg including means adapted to be secured to the first support between the flange and first support.

As a result, the simulated butt hinge gives the appearance of a traditional butt hinge, but is not operating and, thus, does not interfere with the operation of a European type hidden hinge that performs the hinge function.

IN THE DRAWING

FIG. 1 a perspective view of a simulated butt hinge according to one embodiment of the present invention;

FIGS. 1*a* and 1*b* are fragmented front and rear elevation views of an second embodiment of the present invention;

Figure 1:
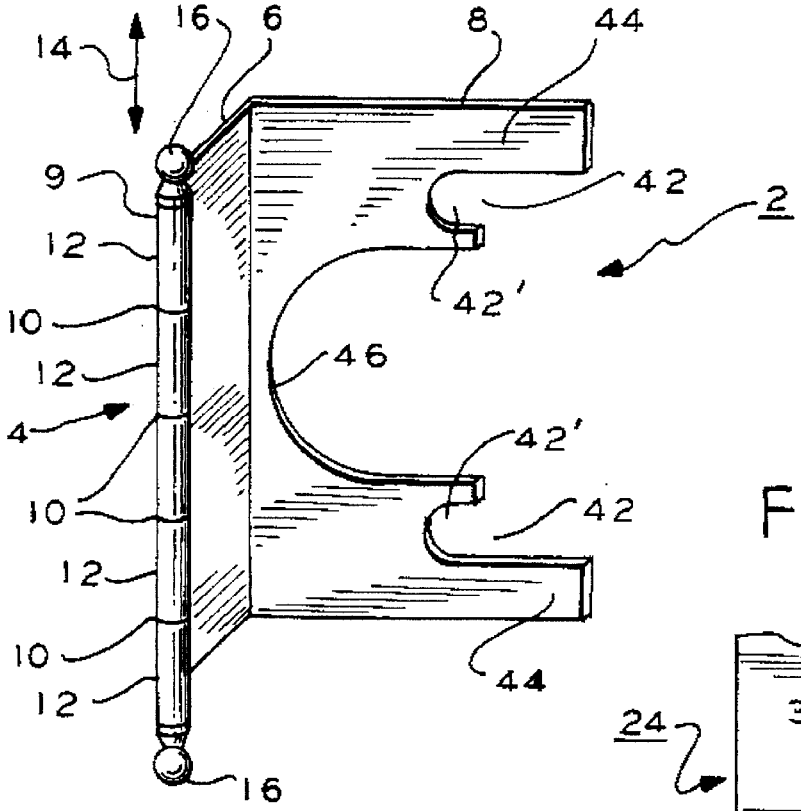

In FIGS. 1–4, simulated butt hinge assembly 2 comprises an artificial hinge 4, a first plate member 6 extending from hinge 4 and a second plate member 8 depending from member 6, all formed as an integral, one piece integral unit, preferably brass. The hinge 2 may be formed of other materials such as molded thermoplastics and other types of metals, depending upon a given implementation. The plate members 6 and 8 are at right angles forming an L-shaped member, but could be at other angles according to a given implementation.

The artificial hinge 4 preferably is formed of bent sheet material, e.g., sheet metal, and formed with a preferably generally circular cylindrical member 9 with a plurality of axially spaced semi-annular grooves 10. The grooves 10 are generally the same dimensioned depressions formed in the bent sheet material and encircle the cylindrical member 9. The grooves 10 divide the external surface of cylindrical member 9 into a plurality of simulated knuckles 12. The simulated knuckles thus comprise a single piece of rolled over sheet material, and form a single non-operating gudgeon.

All of the simulated knuckles 12 are preferably of the same axial extent in directions 14. This simulates knuckles which in an operating butt hinge are articulated about a hinge pin or pintle and connected to two separate plate members.

Attached to the top and bottom ends of the member 9 aligned simulated knuckles 12 are top and bottom decorative finials 16. The finials 16 are separate elements and include circular cylindrical tenons 11 which are inserted into the gudgeon of member 9. The artificial hinge 4, in the alternative, may be formed as a solid structure rather than sheet material wherein the member 9 is solid rather than hollow. In this embodiment, the hinge 4 may be formed by casting or by any other known process. The finials 16 in this case may be cast with the cylindrical member 9 and are integral and one piece with the member 9.

Figure 1A:
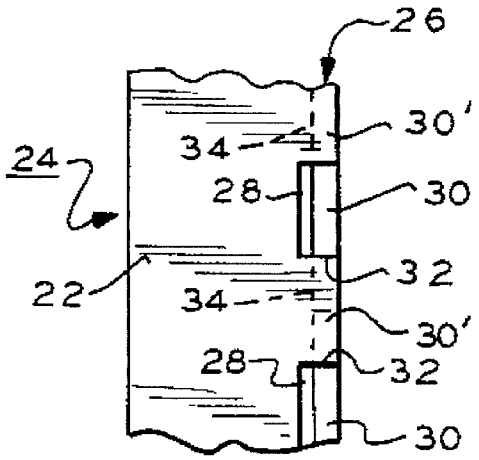
Figure 2:
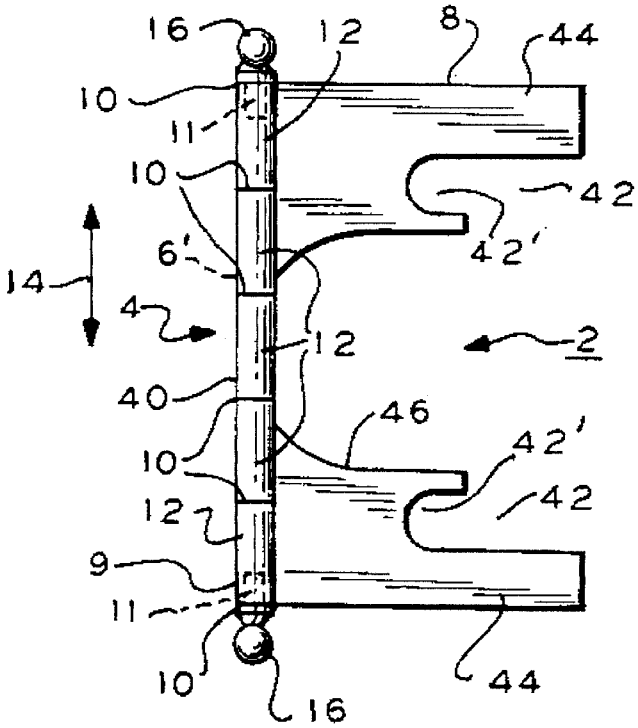
FIG. 2 is a front elevation view of the embodiment of FIG. 1.
Figure 1B:
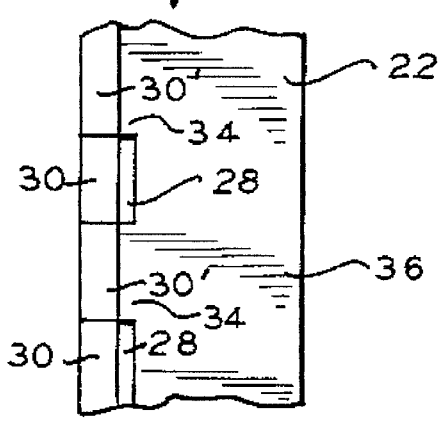

In an alternative embodiment, in FIGS. 1*a* and 1*b*, plate 22 of simulated hinge 24 is attached to artificial hinge 26. Artificial hinge 26 is a one-piece integral structure with plate 22. However, to provide further realism, cutouts 28 are formed between simulated knuckles 30 and plate 22 at alternate knuckles 30. Arcuate grooves 32 provide the appearance of separate knuckles 30. However, the region 34 coupling alternate knuckles 30 is flat and coextensive with plate 22 and the knuckles 30 on one side of plate 22. The cutouts 28 give the appearance that knuckles 30 are connected to a separate plate different than plate 22 as occurs in an articulating butt hinge assembly. Side 36 of plate 22 abuts a panel edge 18 to which the hinge 24 is to be attached. The hinge 24 may be fabricated of sheet material or cast as a solid unit.

Figure 3:
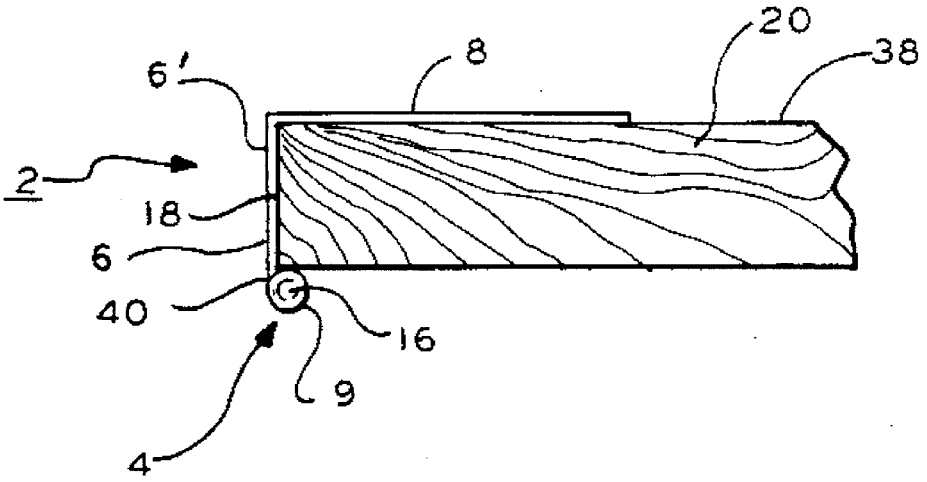
FIG. 3 is a plan view of the hinge of FIG. 1 attached to a fragmented mating panel.

The plate member 6, FIG. 3, abuts edge 18 of a panel 20, such as a door, a joint, or a casement and so on. The width of plate member 6 is the same as panel 20 so that plate member 8 abuts face 38 of panel 20. Panel 20 may be wood or any other materials to which the simulated hinge 2 is attached.

The artificial hinge 4 is constructed, FIG. 3, so that sides 40 of the knuckles 12 are coplanar with surface 6' of plate member 6. This is important for reasons to be discussed below.

Plate member 8 is formed with two like openings 42 having a semi-circular portion 42'. Openings 42 form legs 44 in member 8. A larger central semi-circular opening 46 is formed symmetrically between legs 44 and openings 42. The plate members 6 and 8 may be recessed, if desired, in mating mortises in the panel 20.

Figure 5:
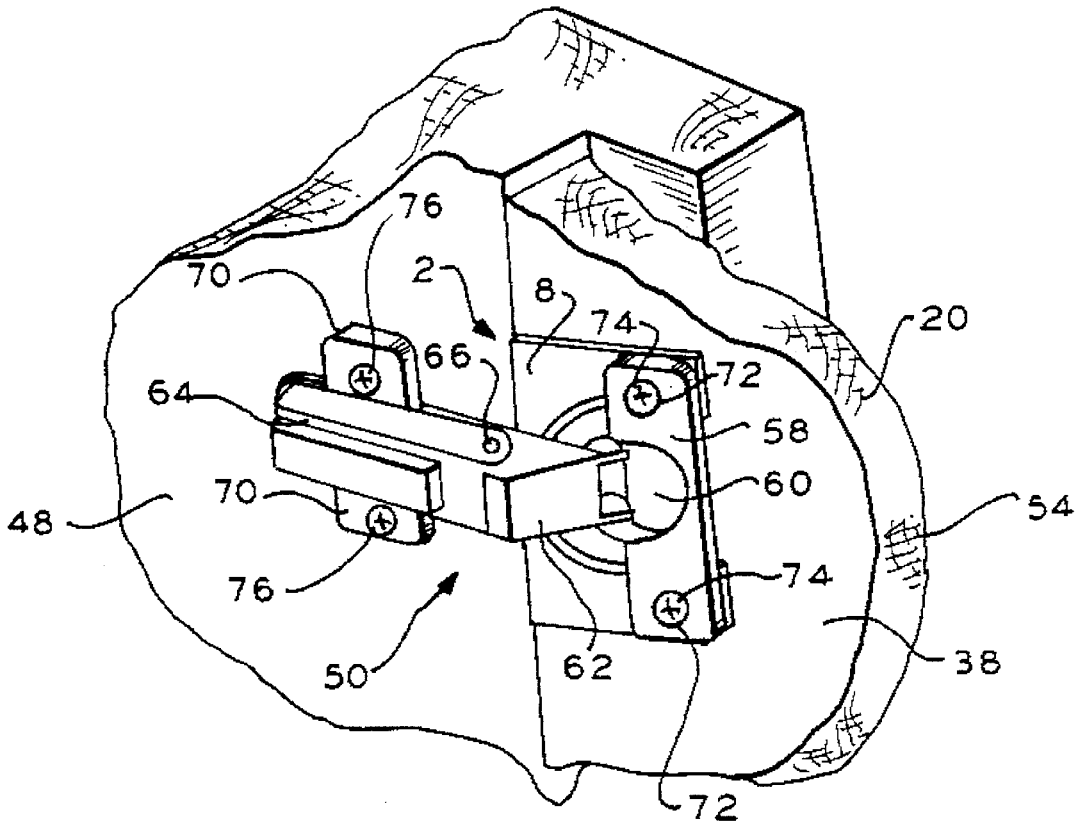
FIG. 5 is a rear isometric view of the embodiment of FIG. 4 further including a European hidden articulating snap type spring loaded hinge attached to fragmented mating door and casement structures in an open door position.
Figure 6:
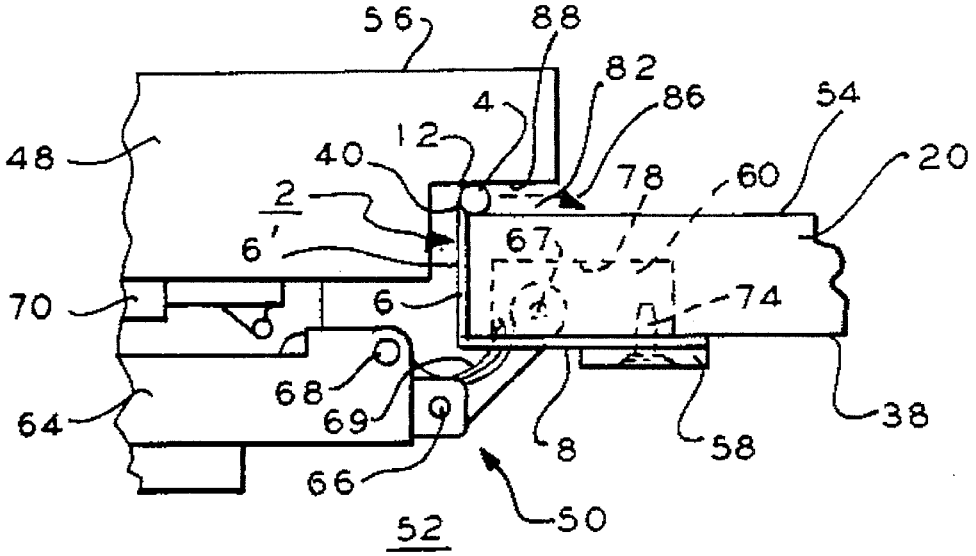
FIG. 6 is a plan view of the embodiment of FIG. 5.
Figure 7:
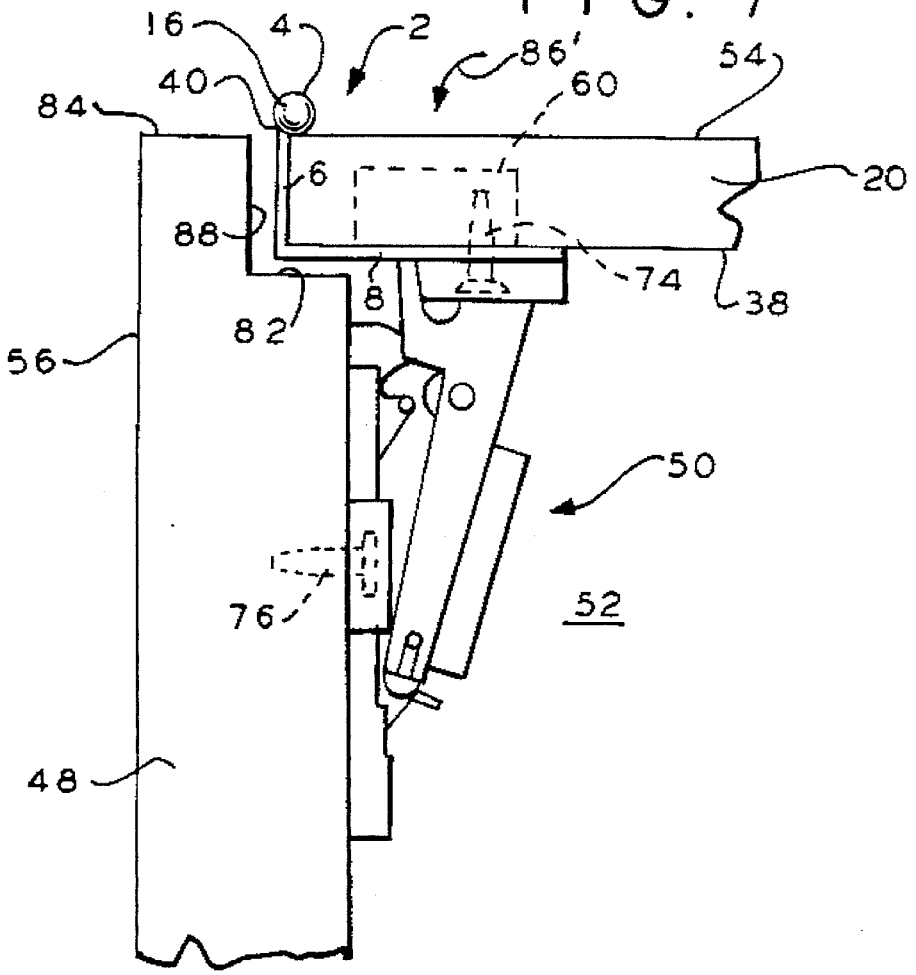
FIG. 7 is a plan view of the embodiment of 5 showing the door and casement in a closed position.

In FIGS. 5, 6 and 7, panel 20 is hinged to a cabinet frame 48 by a European type hidden articulating self closing hinge assembly 50. Assembly 50 is referred to as a hidden type because it is attached to panel 20 and frame 48 in the interior space 52 of a cabinet or furniture piece. The exterior faces 54 and 56 of respective panel 20 and cabinet frame 48 hide the hinge assembly 50 when the panel 20 is in the closed position of FIG. 7.

Hinge assembly 50 is conventional and commercially available. Only so much of assembly 50 will be described for understanding the present invention. The hinge assembly 50 includes a flange 58, a cup 60, an articulating sheet metal spring 69, and a leg 62 hinged to cup 60 and to support body 64. Leg 62 is hinged to cup 60 at pin 67 and to support body 64 at pin 66. Pin 68 receives one end of bent sheet metal spring 69 the other end being hinged to the cup 60 causing the snap action of assembly 50 to the open position of FIGS. 5 and 6 and closed position of FIG. 7. The spring 69 is thus hinged separately to cup 60 and support 64. The support body 64 has a pair of opposing mounting flanges 70.

Flange 58 has a pair of screw holes 72 for receiving screws 74. The flanges 70 have screw holes for receiving screws 76.

Figure 4:
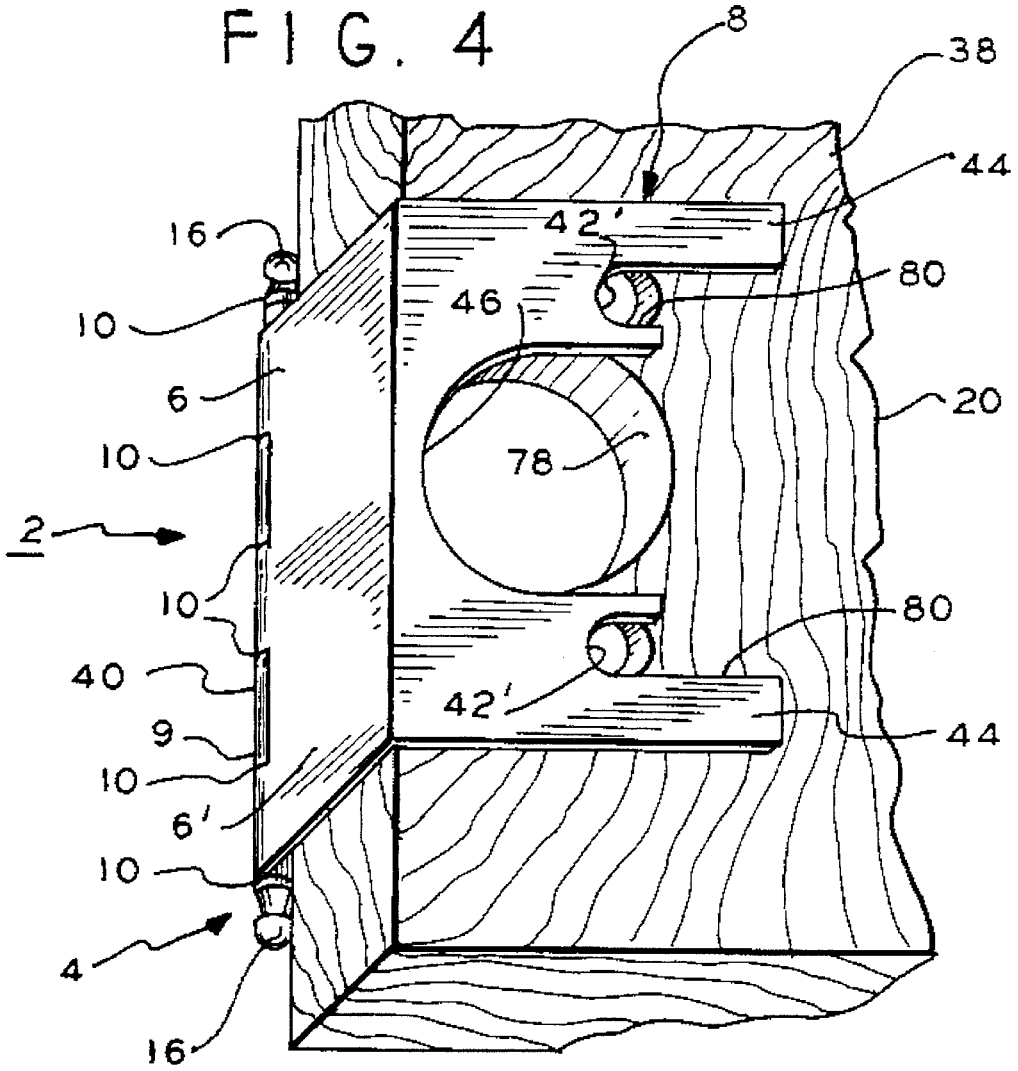
FIG. 4 is an isometric view of the embodiment of FIG. 3.

In FIG. 4, panel 20 has a circular cylindrical recess 78 and two smaller circular recesses 80. Recess 78 receives the cup 60 of hinge assembly 50. The recesses 80 receive the screws 74 for attaching the assembly 50 flange 58, FIG. 5, to the panel 20. This attaches the articulating leg 62 to the panel 20. Screws 76 attach flanges 70 to cabinet frame 48 to thereby secure the hinge assembly 50 for articulating the panel 20 to the frame 48.

As seen in FIG. 4, the plate member 8, opening 46 is aligned over and exposes the recess 78 of panel 20. Similarly, the openings 42 are aligned to expose respective recesses 80. However, no fastening devices are used to directly secure the simulated hinge 2 to the panel 20.

To assemble the simulated hinge 2 to the panel 20, the hinge 2 is placed against the panel as shown in FIG. 4. The articulating hinge assembly 50 is then fastened to the panel 20 over the plate member 8. The flange 58 abuts the member 8 legs 44. The cup 60 and hinge assembly 50 leg 62 attached to cup 60 fit in the opening 46 of plate member 8. Thus, only a portion of member 8 visible on the rear side hinge assembly 50 of the panel 20 when the assembly 50 is secured to panel 20. The flange 58 clamps the member 8 to panel 20 without further fasteners. Thus, the simulated hinge 2 is aligned exactly with the articulating hinge assembly 50 and secured to the panel 20 by assembly 50.

In operation, when the door panel 20 is closed, FIG. 7, the simulated hinge 2 artificial hinge 4 is adjacent to the external face 54 of panel 20. This gives the appearance to the panel 20 and cabinet frame 48 that they are attached by a traditional butt hinge. The frame 48 has a stepped recess 82 which receives the hinge 2 end of panel 20 so that panel 20 face 54 is flush or substantially coplanar with the frame end surface 84. The artificial hinge 4 projects beyond the face 54 and surface 84 as would a conventional articulating butt hinge.

The side 40 of the artificial hinge 4 knuckles 12, FIG. 6, is coplanar at most with, and does not project beyond, the outer surface 6' of plate member 6. This allows the hinge 4 knuckles 12 to clear surface 88 when the hinge 4 is displaced in the arcuate path 86 about the hinge assembly 50 hinge axis. This axis also translates during relative rotation of the hinge 50 assembly elements. This translation of panel 20 is in the closing direction 86, FIG. 6 or in the reverse opening direction 86', FIG. 7.

By so constructing the artificial hinge 4, clearance is provided between the hinge 4 simulated knuckles 12 and surface 88 of the frame 48 recess 82 during articulation of the hinge assembly 50. Thus, as panel 20 swings as it is moved from the closed position of FIG. 7 to the open position of FIG. 6, or vice versa, the knuckles 12 clear the surface 88. The hinge assembly 50, panel 20 and frame 48 are preassembled, installed without the simulated hinge 2 as exists in homes, businesses and the like. As a result, the clearance between the panel 20 and frame 48 are preset by this preassembled arrangement of cabinet components.

The simulated hinge 2 is advantageously useful as a retrofit for such preassembled components. No tools or machinery are required to assemble the hinge 2 to such components other than a conventional screwdriver. The screwdriver is used to loosen the screws 74 of the flange 58 of the hinge assembly 50 sufficiently for the plate member 8 to be slid between the flange 58 and the panel 20 or, in the alternative, by removing and reattaching the flange 58, FIG. 5. This operation is done quickly and simply without deleterious effect on the appearance or operation of panel 20, frame 48 and hinge assembly 50.

In the embodiment of FIGS. 5–7 the hinge 4 is shown for mounting a door to a frame so as to clear the frame during articulation of the door. However, other embodiments include arrangements wherein an artificial hinge 4 may be secured to adjacent doors which are hinged by corresponding articulating hinges to opposite sides of a cabinet frame. In this case the edges of the doors are in facing spaced relation. An artificial hinge is attached to each door in the interface clearance region between the facing door edges so as to give the appearance of two adjacent butt hinges. These butt hinges use the principle of the offset arrangement of side 40 of the knuckles discussed above to provide clearance between the butt hinges as the doors are opened and closed.

Figure 8:
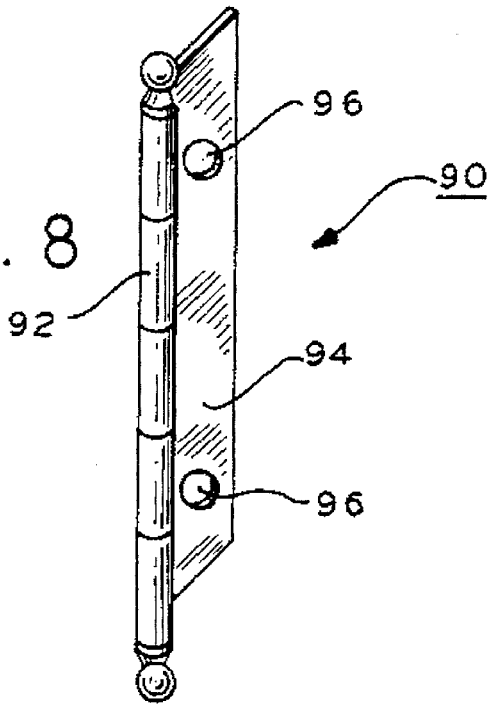
FIG. 8 is an isometric view of a third embodiment of the hinge of the present invention.

In FIG. 8, an alternate embodiment of a simulated butt hinge assembly 90 includes an artificial hinge 92 constructed as described above. A plate 94 is formed integral with and as a one piece construction with hinge 92. For example, hinge 90 may be cast brass, molded thermoplastic or other materials. Plate 94 is attached to a typical door or frame edge surface such as surface 18, FIG. 3, by screws (not shown) via aperture 96.

Figure 9:
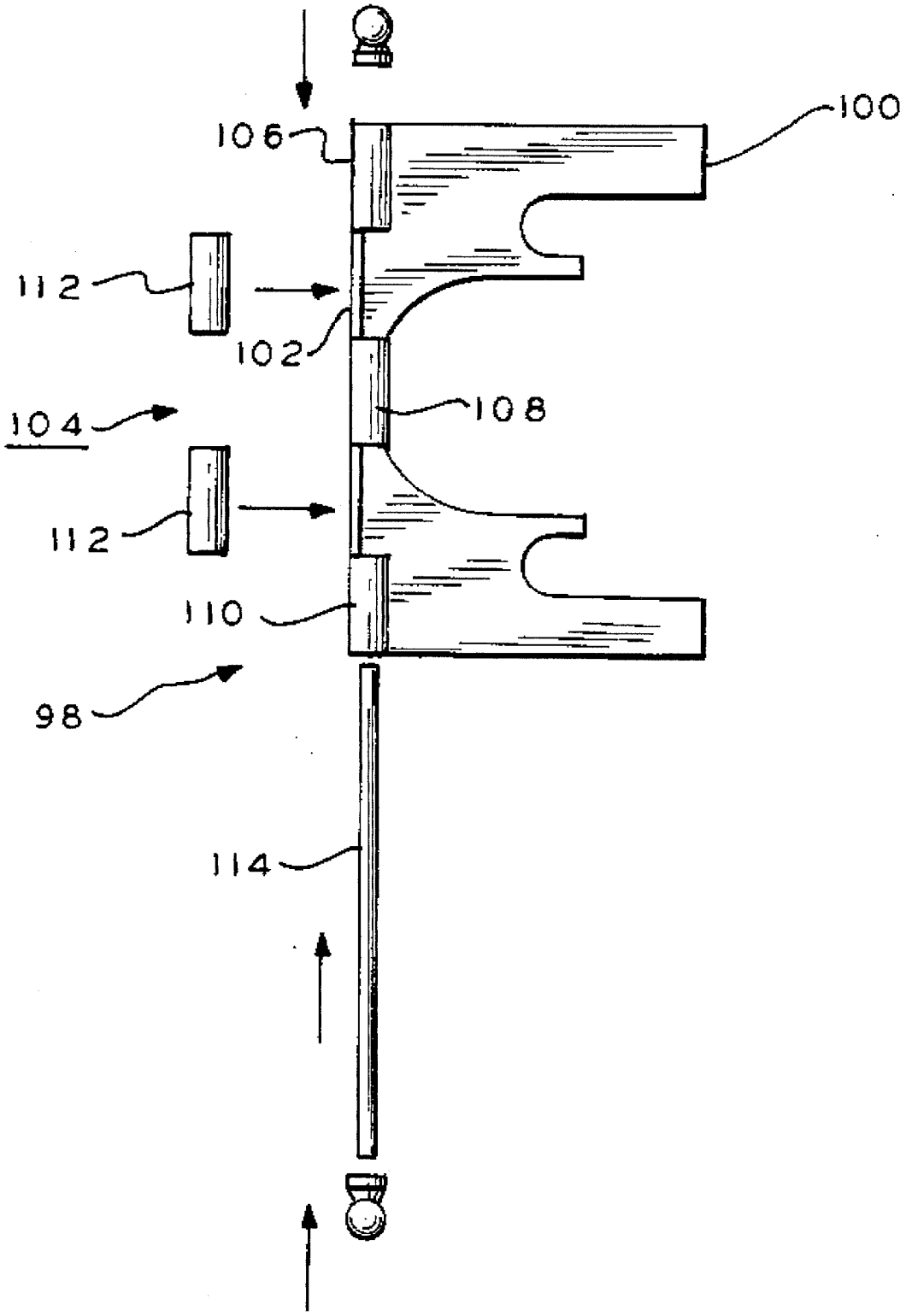
FIG. 9 is an exploded view of a fourth embodiment of the present invention.

In FIG. 9, an alternative embodiment of a simulated hinge assembly 98 includes a plate member 100 the same in construction as plate member 8, FIG. 1. A second plate member 102 is secured to and bent at an edge of plate member 100 in the same construction as plate member 8, FIGS. 1–4. The difference between simulated hinge assembly 98 and simulated hinge assembly 2, FIGS. 1–4, lies in the construction of the artificial hinge 104. The artificial hinge 104 comprises three axially aligned knuckles 106, 108 and 110 which are integral with and one piece with plate member 102. A pair of knuckles 112 which are circular cylindrical tubes form gudgeons. The knuckles 106, 108 and 110 also have gudgeons. The knuckles 112 slip between the adjacent knuckles 106–108 and 108–110 and their respective gudgeons aligned.

A pintle 114 is inserted in the aligned gudgeons of knuckles 106, 108, 110 and 112. This secures the knuckles 112 in place as in a conventional articulating butt hinge assembly. However, no plate is secured to knuckles 112. A finial 116 is secured to each end of pintle 114 to form a completed, assembled simulated butt hinge 104. Hinge 104 has the general appearance of hinge 2, FIGS. 1–4, except hinge 104 is more realistic in that openings corresponding to cutouts 28, FIG. 16, are present as would occur in an actual articulating butt hinge. Also, the pintle 114 and separate knuckles 112 provide a realistic look to hinge 104.

It will occur to one of ordinary skill that various modifications may be made to the disclosed embodiments, it being intended that the scope of the invention be defined by the appended claims.

What is claimed is:

1. A simulated butt hinge construction for attachment to a first support comprising:

a plate member arranged to be attached to said first support; and an artificial butt hinge secured to the plate member for providing a simulated appearance of a butt hinge to said first support.

2. The construction of claim 1 wherein said artificial butt hinge and plate member are an integral one piece unit.

3. The construction of claim 2 wherein the artificial butt hinge and plate member are formed of sheet metal.

4. The construction of claim 1 wherein said plate member is L-shaped for abutting said first support in two orthogonal planes.

5. The construction of claim 4 including an articulating hinge attached to a first support surface on said first support for movably securing the first support to a second support wherein the L-shaped plate member has a first leg secured to the artificial butt hinge and a second leg joined to the first leg at a joint therebetween, said second leg being arranged to be secured to said first support surface, said first support having a second surface overlying and opposing the first surface, said artificial hinge being located adjacent to the second surface.

6. The construction of claim 1 wherein said plate member has opposing sides each lying in a plane, said artificial hinge projecting from the plate member from the region between the planes with a major portion thereof projecting beyond said region through only one of said planes.

7. The construction of claim 5 wherein said plate member has opposing sides each lying in a plane, said artificial hinge projecting from the plate member from the region between the planes with a major portion thereof projecting beyond said region through only one of said planes so as to be juxtaposed with said first support.

8. The construction of claim 5 wherein said articulating hinge has a flange for attachment to said first support, said second leg including means adapted to be clamped to the first support between the flange and first support.

9. The construction of claim 8 wherein the flange has at least one aperture for receiving a fastener for attaching the flange to said first support, said second leg of the plate member having an opening for receiving said fastener therethrough.

10. The construction of claim 9 wherein the articulating hinge includes projecting means which project beyond said flange into said first support, said second leg of the plate member including a further opening for receiving said projecting means.

11. The construction of claim 1 wherein said artificial butt hinge is solid material with an exterior surface having a plurality of spaced grooves simulating a plurality of axially aligned knuckles of a butt hinge.

12. The construction of claim 11 wherein said aligned knuckles have opposing ends, further including an end cap at at least one end aligned with said knuckles.

13. The construction of claim 1 wherein said artificial butt hinge comprises a plurality of axially aligned first spaced hollow knuckles rigidly secured to said plate member, a plurality of aligned second knuckles each comprising solely a cylindrical member with a bore, each second knuckle being received between a different pair of first knuckles, a hinge pin received in said first and second knuckles, and at least one end cap secured to the hinge pin at one end thereof.

14. A simulated butt hinge construction for attachment to a first support comprising:

a plate member having openings arranged to facilitate attachment of said plate member to said first support; and an artificial butt hinge secured to the plate for providing a simulated appearance of a butt hinge to said first support, said hinge and plate member comprising an integral unitary one piece construction.

15. The construction of claim 14 including an articulating hinge attached to said first support, said support having a first surface for receiving said articulating hinge, said articulating hinge including flange means for attachment to said surface, said plate member being adapted to be frictionally secured to said first surface by said flange.

16. The construction of claim 15 wherein said first support has a second surface juxtaposed with the second surface in opposing relation, said artificial butt hinge being positioned adjacent to said second surface.

17. The construction of claim 16 wherein the artificial butt hinge projects from said plate member in one direction only normal to said plate member so as to overly said second surface.

18. A simulated butt hinge assembly comprising:

an L-shaped plate member having first and second legs;

an artificial butt hinge secured to the first leg at an edge thereof, said artificial butt hinge comprising a cylindrical member having opposing ends and a plurality of spaced grooves dividing said cylindrical member between the ends into a plurality of simulated knuckles; and a finial at each end of the cylindrical member.

19. The assembly of claim 8 wherein the second leg has a plurality of cutouts for receiving an articulating hinge to clamp the second leg to a support.

* * * * *